US008910747B2

(12) United States Patent
Lee et al.

(10) Patent No.: US 8,910,747 B2
(45) Date of Patent: Dec. 16, 2014

(54) TAIL PIPE ASSEMBLY FOR VEHICLE

(75) Inventors: Sang Il Lee, Suwon-si (KR); Dea Gil Hwang, Suwon-si (KR); Jay-Yon Jo, Ansan-si (KR); Jongho Seon, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 289 days.

(21) Appl. No.: 13/529,677

(22) Filed: Jun. 21, 2012

(65) Prior Publication Data

US 2013/0025702 A1 Jan. 31, 2013

(30) Foreign Application Priority Data

Jul. 28, 2011 (KR) ..... 10-2011-0075164

(51) Int. Cl.
*F01N 13/08* (2010.01)
*F01N 13/00* (2010.01)

(52) U.S. Cl.
CPC ..... *F01N 13/082* (2013.01); *F01N 2260/00* (2013.01); *F01N 2470/02* (2013.01)
USPC ..... 181/227; 181/228; 60/309

(58) Field of Classification Search
CPC ..... F01N 13/082; F01N 2470/02; F01N 2260/00; F01N 2240/22; F01N 3/005; F16L 55/00
USPC ..... 181/227, 228, 241, 243, 260; 60/309, 60/324
See application file for complete search history.

(56) References Cited

U.S. PATENT DOCUMENTS

| | | | | | |
|---|---|---|---|---|---|
| 1,342,464 | A | * | 6/1920 | Sawders et al. | 181/239 |
| 1,388,554 | A | * | 8/1921 | Dubben et al. | 181/264 |
| 2,498,979 | A | * | 2/1950 | Bourne | 181/260 |
| 2,717,049 | A | * | 9/1955 | Langford | 96/377 |
| 2,921,432 | A | * | 1/1960 | Marcotte et al. | 55/307 |
| 3,114,617 | A | * | 12/1963 | Rowe et al. | 55/315.1 |
| 3,406,501 | A | * | 10/1968 | Watkins | 96/135 |
| 3,675,398 | A | * | 7/1972 | Giarrizzo | 96/132 |
| 3,988,113 | A | * | 10/1976 | Roberts et al. | 422/177 |
| 4,527,659 | A | * | 7/1985 | Harrington | 181/244 |
| 4,696,368 | A | * | 9/1987 | Hummel et al. | 180/309 |
| 5,912,370 | A | * | 6/1999 | McConkey | 55/385.3 |
| 6,012,285 | A | * | 1/2000 | Lutz et al. | 60/309 |
| 7,329,298 | B1 | * | 2/2008 | Hasinski | 55/385.3 |
| 7,523,605 | B2 | * | 4/2009 | Whitaker | 60/297 |
| 7,587,894 | B2 | * | 9/2009 | Kang et al. | 60/309 |
| 7,779,961 | B2 | * | 8/2010 | Matte | 181/227 |
| 8,001,770 | B2 | * | 8/2011 | Wirth et al. | 60/286 |
| 8,356,690 | B2 | * | 1/2013 | Wakatsuki | 181/227 |
| 8,733,086 | B2 | * | 5/2014 | Han et al. | 60/309 |
| 2004/0206573 | A1 | * | 10/2004 | Hsu | 181/228 |
| 2006/0112683 | A1 | * | 6/2006 | Huber | 60/324 |
| 2012/0073275 | A1 | * | 3/2012 | Han et al. | 60/309 |

FOREIGN PATENT DOCUMENTS

| | | | |
|---|---|---|---|
| DE | 102011081310 | A1 * | 2/2013 |
| JP | 2003-247460 | A | 9/2003 |
| JP | 2010-127161 | A | 6/2010 |
| KR | 10-0488785 | B1 | 5/2005 |

* cited by examiner

*Primary Examiner* — Edgardo San Martin

(74) *Attorney, Agent, or Firm* — Morgan, Lewis & Bockius LLP

(57) ABSTRACT

A tail pipe assembly for a vehicle includes a tail pipe mounted to a muffler of the vehicle and discharging exhaust gas and condensation water to an outside, and at least one main collecting element that is mounted within the tail pipe, suppresses flow of the condensation water and temporarily stores the condensation water.

19 Claims, 10 Drawing Sheets

TAIL PIPE ASSEMBLY FOR VEHICLE

CROSS-REFERENCE TO RELATED APPLICATION

The present application claims priority of Korean Patent Application Number 10-2011-0075164 filed in the Korean Intellectual Property Office on Jul. 28, 2011, the entire contents of which application is incorporated herein for all purposes by this reference.

BACKGROUND OF INVENTION

1. Field of Invention

The present invention is related to a tail pipe assembly for a vehicle. More particularly, the present invention relates to a tail pipe assembly for a vehicle which may collect condensation water and temporarily store the condensation water.

2. Description of Related Art

A muffler, which is used for an exhaust system of a vehicle, is a device for suppressing exhaust noise, such as decreasing the sound level of escaping gases of an internal-combustion engine by lowering temperature and pressure of the exhaust gas.

The muffler shaped as a pipe has divided sections and noise may be reduced while traveling through the sections with interference of sound wave, reduction of pressure fluctuation, reduction of exhaust gas temperature and so on. In this situation, condensation water is formed within the muffler due to cooling of the exhaust gas.

Recently, a GDI (Gasoline Direct Injection) engine is applied to a vehicle worldwide, and the vehicle with the GDI engine may generate soot within the exhaust gas considerably. The soot of the exhaust gas may be mixed with condensation water formed within the muffler and thus the condensation water becomes darker. When the vehicle with the GDI engine is in idle, the dark condensation water is drained to ground and the ground where the vehicle stayed is contaminated. And thus the dark condensation water becomes the cause of pollution.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present application are directed to provide a tail pipe assembly for a vehicle that may collect condensation water and temporarily store the condensation water.

Various aspects of the present invention provide for a tail pipe mounted to a muffler of the vehicle and discharging exhaust gas and condensation water to an outside, and at least one main collecting element that is mounted within the tail pipe, suppresses flow of the condensation water and temporarily stores the condensation water.

A mounting portion may be formed or connected to the tail pipe. The mounting portion may have a cross section that is larger than the tail pipe, and the at least one main collecting element may be mounted to the mounting portion.

The at least one main collecting element may cover the entire interior circumference of the tail pipe. The tail pipe may be bent toward ground.

The at least one main collecting element may include a plurality of main collecting elements that are mounted to an interior circumference of the tail pipe and are apart from each other. The at least one main collecting element may include two main collecting elements that are mounted to an upper portion and a lower portion of an interior circumference of the tail pipe and are apart from each other.

The at least one main collecting element may be formed substantially as a weave. The at least one main collecting element may have substantially a wave shape. The at least one main collecting element may be formed to have convex protrusions and concave depressions.

The tail pipe may further include at least one collecting plate that is disposed within the tail pipe and temporarily stores the condensation water. The at least one collecting plate may include two collecting plates that are mounted to an upper portion and a lower portion of an interior circumference of the tail pipe. A plurality of collecting holes may be formed in the at least one collecting plate for temporarily storing the condensation water.

The at least one main collecting element may be mounted to an upper portion of the interior circumference of the tail pipe, wherein the tail pipe may further include a sub-collecting element that is mounted to a lower portion of the interior circumference of the tail pipe for temporarily storing the condensation water. The tail pipe may further include a collecting plate that is mounted upstream of the sub-collecting element for temporarily storing the condensation water.

A plurality of collecting holes may be formed in the at least one collecting plate for temporarily storing the condensation water.

The at least one main collecting element may be mounted to an upper portion of the interior circumference of the tail pipe, wherein the tail pipe may have an extended portion that may be extended from the muffler and a sub-collecting element may be mounted to a lower portion of the extended portion for suppressing flow of the condensation water and temporarily storing the condensation water.

The tail pipe assembly may store condensation water temporarily and delay exhausting the condensation water from the tail pipe and thus may prevent contamination of ground where the vehicle stayed.

Also, the tail pipe assembly may be manufactured with simple constituent elements and reduce manufacturing cost.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
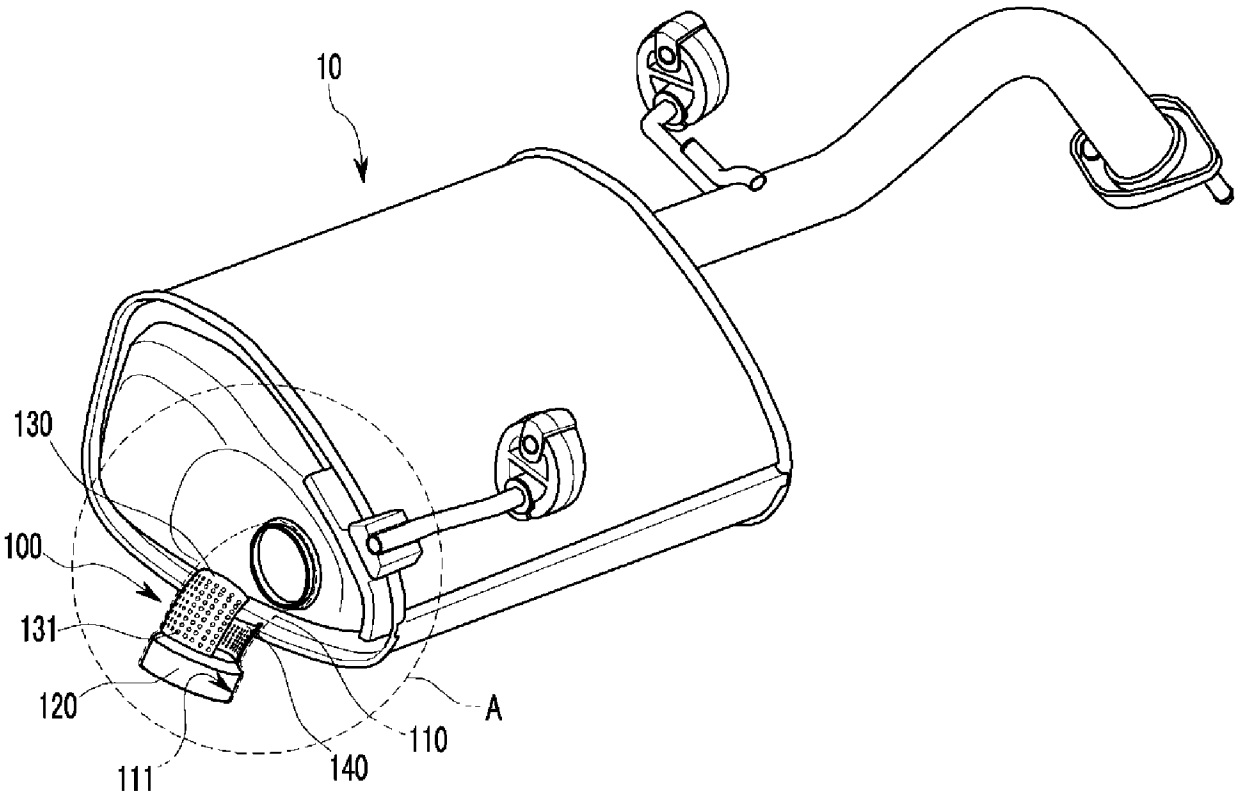
FIG. 1 is a perspective view of an exemplary muffler of which a tail pipe assembly according to the present application is applied thereto.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Like numerals refer to like elements throughout the specification. In the drawings, the thickness of layers, films, panels, regions, and other components are not drawn in proportion, and some are exaggerated for clarity.

FIG. 1 is a perspective view of a muffler of which a tail pipe assembly according to various embodiments of the present invention is applied thereto.

Referring to the drawing, a tail pipe assembly 100 according to various embodiments of the present application is mounted to a muffler 10 for exhausting exhaust gas from the muffler 10. The muffler 10 is a device for suppressing exhaust noise, such as decreasing the sound level of escaping gases of an internal-combustion engine by lowering temperature and pressure of the exhaust gas.

The tail pipe assembly 100 according to various embodiments of the present application is provided for collecting condensation water formed by cooling the exhaust gas and for delaying exhausting the condensation water.

Figure 2:
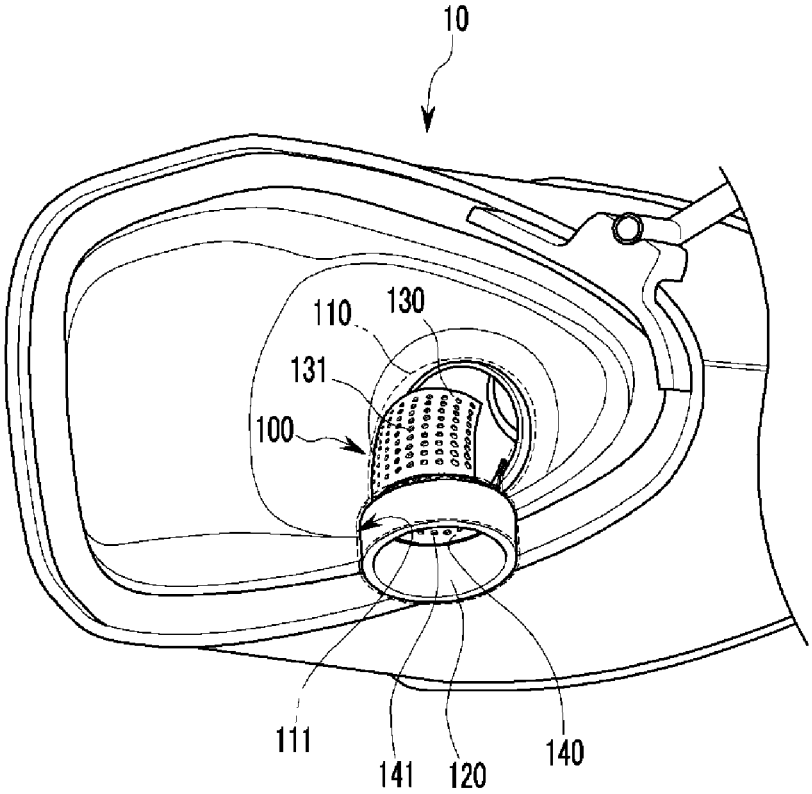
FIG. 2 is an enlarged view taken along circle A of FIG. 1.
Figure 3:
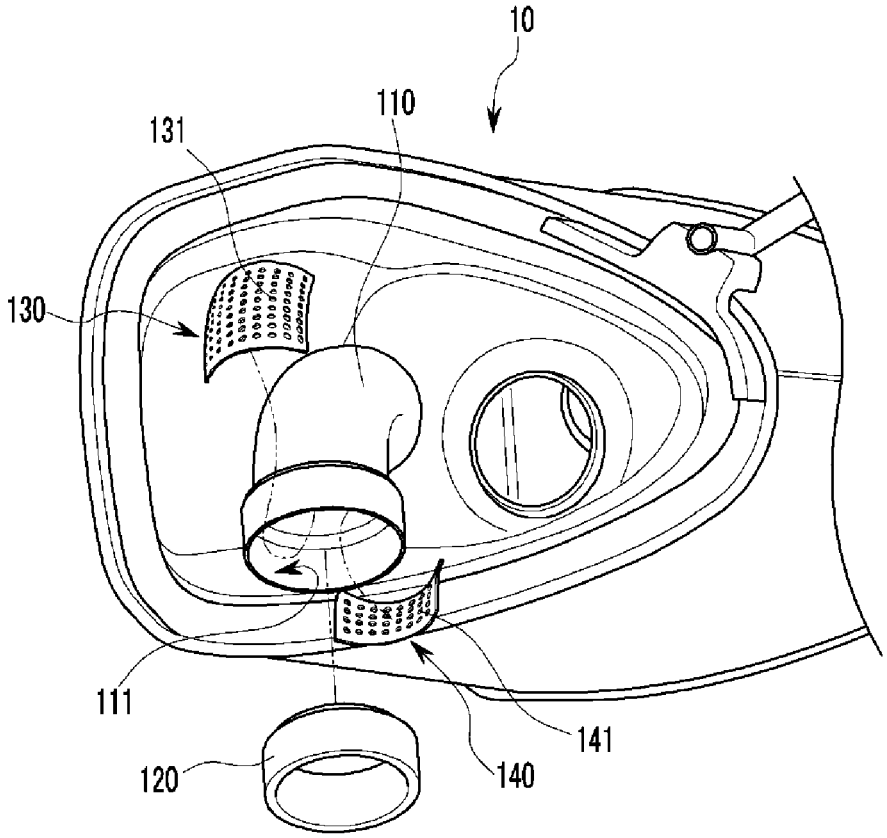
FIG. 3 is an exploded perspective view of an exemplary tail pipe assembly according to the present application.
Figure 4:
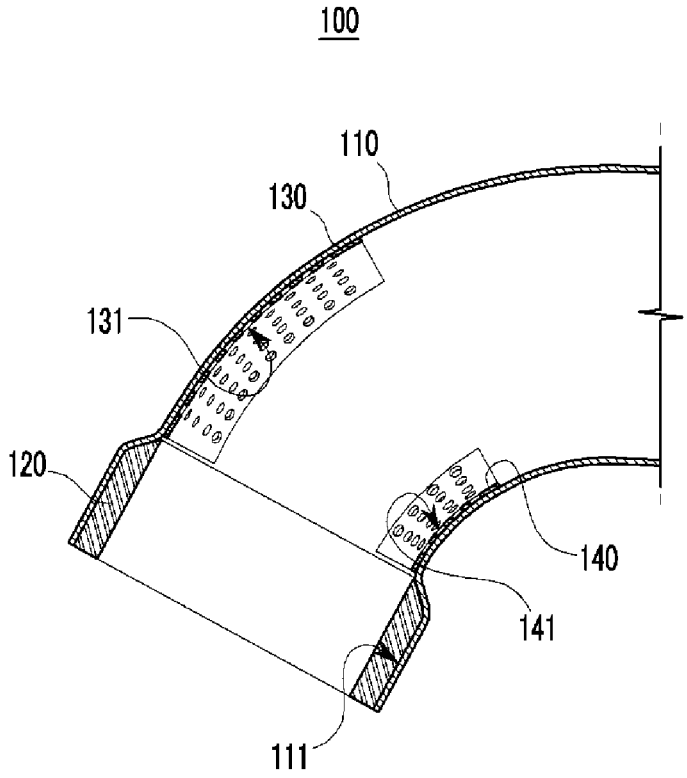
FIG. 4 is a partial cross-sectional view of an exemplary tail pipe assembly according to the present application.

FIG. 2 is an enlarged view taken along circle A of FIG. 1, FIG. 3 is an exploded perspective view of a tail pipe assembly according to various embodiments of the present application, and FIG. 4 is a partial cross-sectional view of a tail pipe assembly according to various embodiments of the present application.

Referring to the drawings, the tail pipe assembly 100 according to various embodiments of the present application includes a tail pipe 110 and a main collecting element 120. The tail pipe 110 is mounted to the muffler 10 of FIG. 1 and discharges exhaust gas and condensation water and the tail pipe 110 may be roundly bent toward ground. A cross section of the tail pipe 110 is enlarged and where a mounting portion 111 is formed or connected thereto, and the tail pipe 110 may be shaped substantially as a circular or oval pipe.

In various embodiments of the present application, the main collecting element 120 may collect condensation water, which is formed by cooling of the exhaust gas with high temperature, suppress discharging of the condensation water and temporarily store the condensation water.

Figure 5:
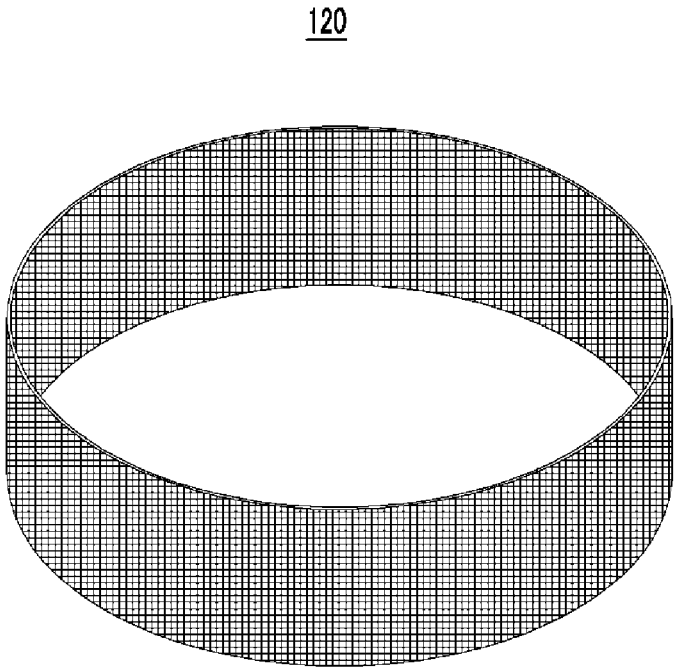
FIG. 5 is a perspective view of a main collecting element which is provided to an exemplary tail pipe assembly according to the present application.
Figure 6:
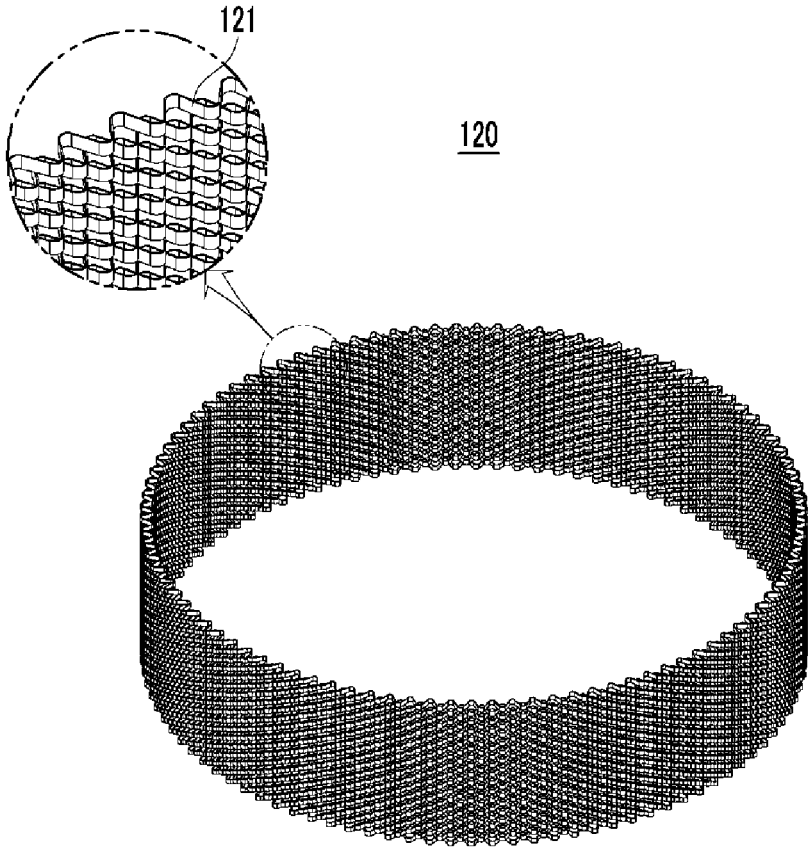
FIG. 6 is a perspective view of another main collecting element which is provided to an exemplary tail pipe assembly according to the present application.
Figure 7:
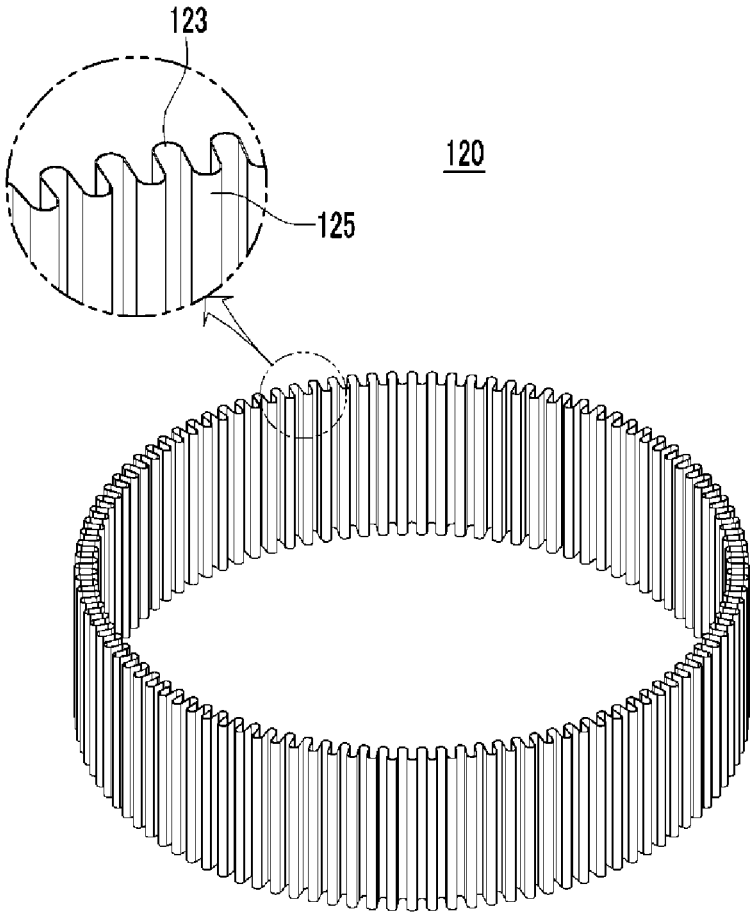
FIG. 7 is a perspective view of another main collecting element which is provided to an exemplary tail pipe assembly according to the present application.

The main collecting element 120 may be mounted to the mounting portion 111 of the tail pipe 110 and may be shaped as a pipe. In various embodiments, the main collecting element 120 may cover the entire interior circumference of tail pipe 110. The main collecting element 120 may be formed substantially as weave shape as shown in FIG. 5, or may be formed substantially as wave shape of which a cross section is alternate, for example, a plurality of collecting rings 121 are alternate, as shown in FIG. 6. Also, the main collecting element 120 may be formed as a protrusion and depression shape with concave 123 and convex 125 as shown in FIG. 7.

In various embodiments of the present application, the tail pipe assembly 100 further includes a collecting plate. And the collecting plate 130 or 140 is disposed within the tail pipe 110 and temporarily stores the condensation water. The collecting plate 130 or 140 may be mounted to an upper portion or a lower portion of the interior circumference of the tail pipe 110.

The collecting plate may be plural and the collecting plates 130 and 140 may be mounted to the upper portion and the lower portion of the interior circumference of the tail pipe 110 for suppression of flowing of the condensation water and may be shaped essentially as a semicircle.

A plurality of the first and the second collecting hole 131 and 141 may be formed to the first and the second collecting plates 130 and 140 respectively for substantially collecting and storing the condensation water.

Referring to FIG. 4, operations of the tail pipe assembly 100 according to various embodiments of the present application will be described hereinafter. The exhaust gas with high temperature discharged from an engine passes through the muffler 10 and generates the condensation water and the condensation water is discharged with the exhaust gas through the tail pipe 110.

The condensation water flowing through the interior circumference of the tail pipe 110 is collected by the first and the second collecting holes 131 and 141 of the collecting plates 130 and 140 before reaching the main collecting element 120. The collecting plates 130 and 140 are disposed to the upper portion and the lower portion of the interior circumference of the tail pipe 110.

If the condensation water collected by the collecting holes 131 and 141 are enough to run over, the condensation water flows to the main collecting element 120 and is collected by a surface of the main collecting element 120. And the surface of the main collecting element 120 has regular or irregular spaces for temporarily storing the condensation water and thus discharging of the condensation water from the tail pipe 110 may be suppressed.

That is, according to various embodiments of the present application, the collecting holes 131 and 141 of the collecting plates 130 and 140 collect the condensation water and the main collecting element 120 also collects the condensation water and thus discharging of the condensation water from the tail pipe 110 may be suppressed.

As described above, in various embodiments of the present application, the main collecting element 120 is mounted to the interior circumference of the tail pipe 110 and the collecting plates 130 and 140 are mounted at the upper portion and the lower portion of the interior circumference of the tail pipe 110 and thus discharging of the condensation water may be suppressed and also contamination of ground where the vehicle stayed may be prevented.

Particularly, in cold start or in idle, discharging of the condensation water may be suppressed or delayed and thus after warming of the tail pipe 110 by the exhaust gas, generation of the condensation water may be suppressed.

Configurations and constructions of the first and the second collecting plate 130 and 140 and the main collecting element 120 are simple and thus productivity may be improved and production cost may be reduced.

Figure 8:
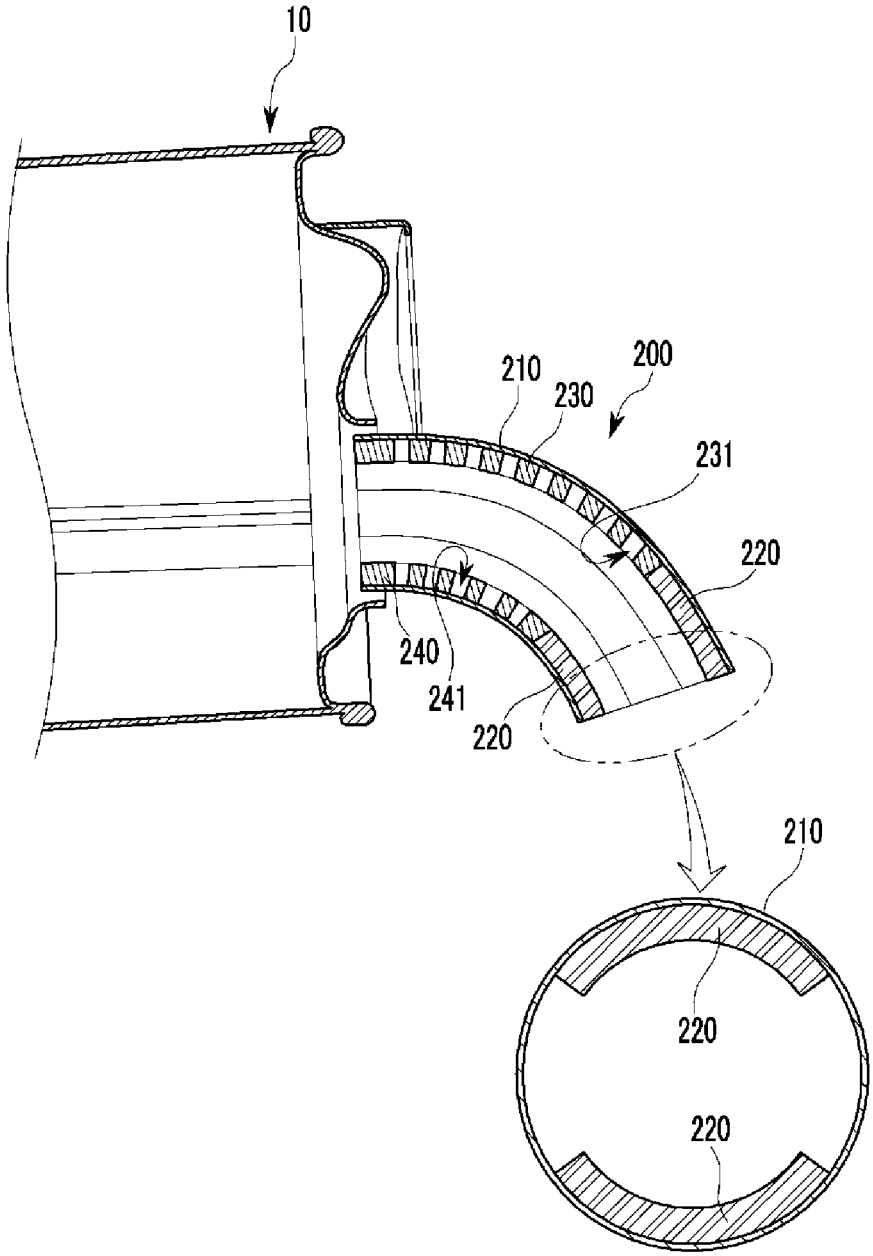
FIG. 8 is a perspective view of an exemplary tail pipe assembly according to the present application.

FIG. 8 is a perspective view of a tail pipe assembly according to various exemplary embodiments of the present application. Referring to the drawing, a tail pipe assembly 200 according to various embodiments of the present application includes a plurality of main collecting elements 220 that are mounted to an interior circumference of a tail pipe 210 and are apart from each other.

In various embodiments, the plurality of main collecting elements 220 are formed essentially as semicircles, comprising one mounted to an upper portion and one mounted to a lower portion of the interior circumference of a tail pipe 210.

Construction of collecting plates 230 and 240 are similar to that of the exemplary embodiments described above of the present application and thus repeated description will be omitted.

In various embodiments of the present application, the condensation water flowing through the interior circumference of a tail pipe 210 may be collected by a plurality of collecting holes 231 and 241 formed to the collecting plates 230 and 240.

If the condensation water collected to the collecting holes 231 and 241 are enough to run over, the condensation water flows to the main collecting elements 220 and is collected by the main collecting elements 220, so that discharging of the condensation water from the tail pipe 210 may be suppressed.

Figure 9:
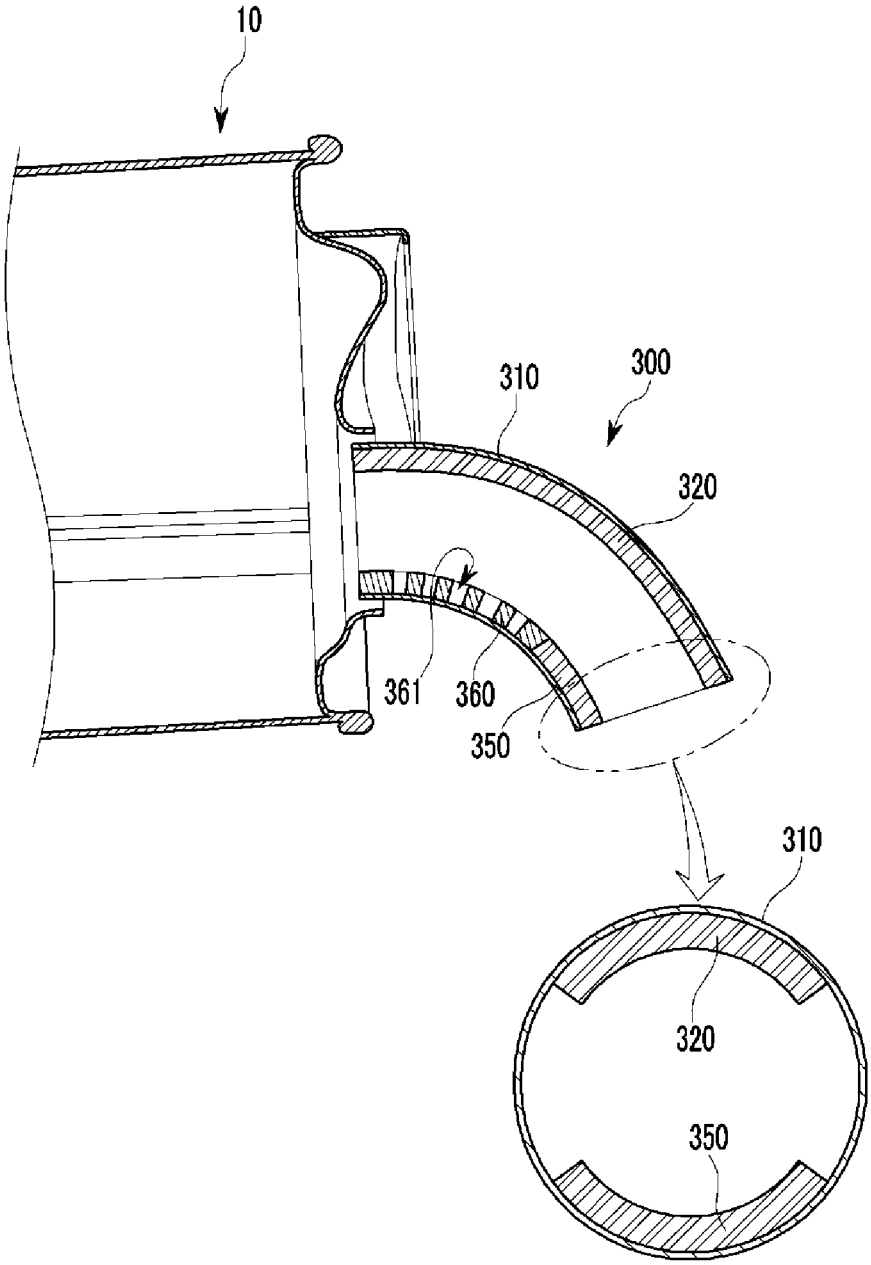
FIG. 9 is a perspective view of an exemplary tail pipe assembly according to the present application.

FIG. 9 is a perspective view of a tail pipe assembly according to various exemplary embodiments of the present application. Referring to the drawing, a tail pipe main collecting element 320 which is mounted to an upper portion of an interior circumference of a tail pipe 310.

And the tail pipe assembly 300 further includes a sub-collecting element 350 which is mounted to a lower portion of the interior circumference of the tail pipe 310 and a collecting plate 360 of which a plurality of collecting holes 361 are formed thereto and which is disposed upstream of the sub-collecting element 350.

In various embodiments, the main collecting element 320 shaped substantially as a semicircle is mounted to the upper portion of the interior circumference of the tail pipe 310 and the sub-collecting element 350 shaped substantially as a semicircle is mounted to the lower portion of the interior circumference of the tail pipe 310. The condensation water flowing through the upper portion of the interior circumference of the tail pipe 310 may be collected by the main collecting element 320.

The condensation water flowing through the lower portion of the interior circumference of the tail pipe 310 may be collected to the collecting holes 361 of collecting plate 360 and then the condensation water is collected to the sub-collecting element 350 when the condensation water collected to the collecting holes 361 of the collecting plate 360 so that discharging the condensation water may be suppressed and delayed.

Figure 10:
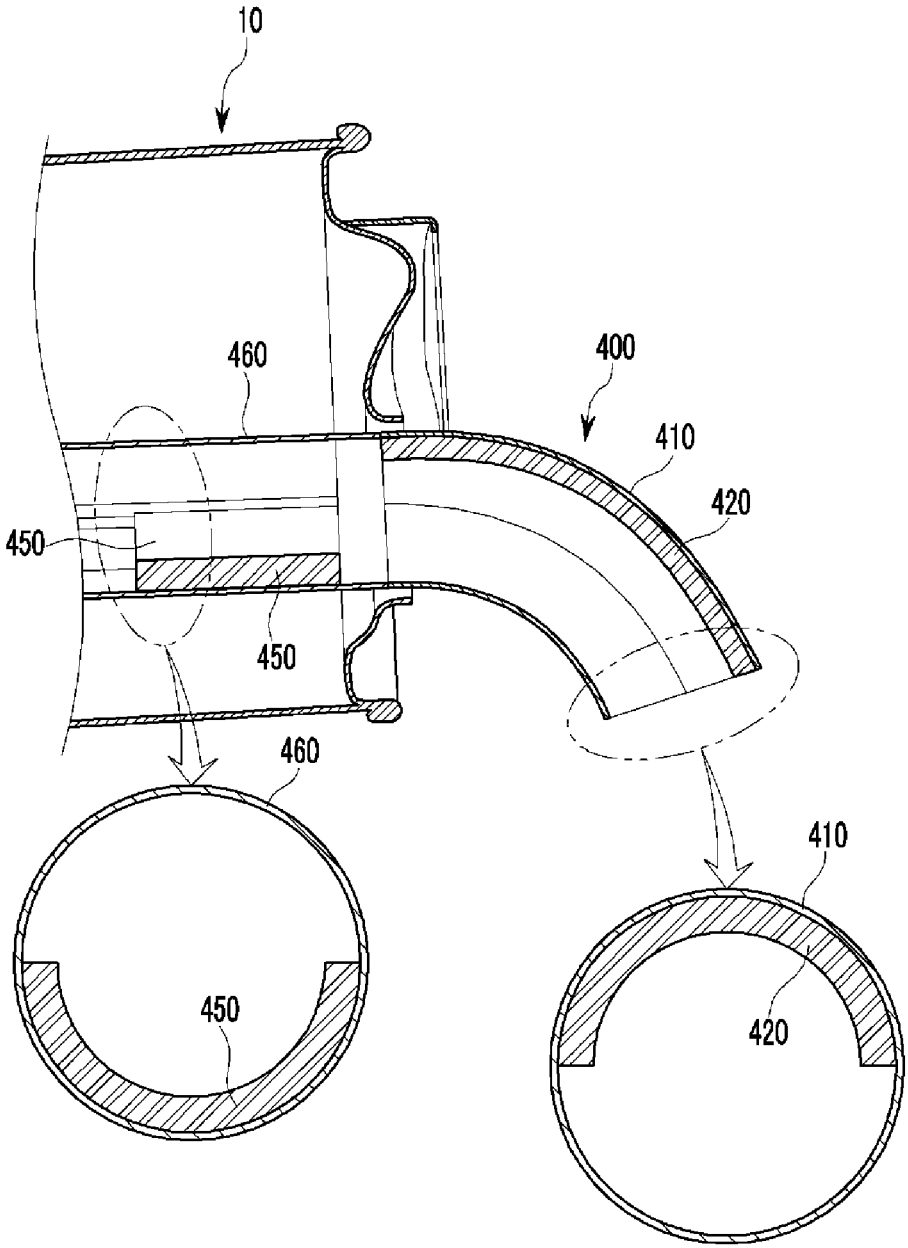
FIG. 10 is a perspective view of an exemplary tail pipe assembly according to the present application.

FIG. 10 is a perspective view of a tail pipe assembly according to various exemplary embodiments of the present application. Referring to the drawing, a tail pipe assembly 400 according to various embodiments of the present application includes a main collecting element 420 which is mounted to an upper portion of an interior circumference of a tail pipe 410.

The tail pipe 410 is extended from the muffler 10 and a sub-collecting element 450 is mounted to a lower portion of the extended portion 460 for suppression of flowing of the condensation water and temporarily storing the condensation water.

In various embodiments, the main collecting element 420 shaped substantially as a semicircle is mounted to the upper portion of the interior circumference of the tail pipe 410 and the sub-collecting element 450 shaped substantially as a semicircle is mounted to the lower portion of the extended portion 460.

The condensation water flowing through the upper portion of the interior circumference of the tail pipe 410 may be collected to the main collecting element 420. Before the condensation water flows through a lower portion of the interior circumference of the tail pipe 410, the condensation water is collected to the sub-collecting element 350 mounted to the lower portion of the extended portion 460 so that discharging the condensation water may be suppressed and delayed.

For convenience in explanation and accurate definition in the appended claims, the terms "upper" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled well as various alternatives and modifications thereof. It is intended that the scope of the invention be defined by the Claims appended hereto and their equivalents.

What is claimed is:

1. A tail pipe assembly for a vehicle comprising:

a tail pipe mounted to a muffler of the vehicle and discharging exhaust gas and condensation water to an outside; and at least one main collecting element that is mounted within the tail pipe, suppresses flow of the condensation water and temporarily stores the condensation water;

wherein the at least one main collecting element includes a plurality of main collecting elements that are mounted to an interior circumference of the tail pipe and are apart from each other.

2. The tail pipe assembly of claim 1, further comprising:

a mounting portion connected to the tail pipe, the mounting portion having a cross section that is larger than the tail pipe, wherein the at least one main collecting element is mounted to the mounting portion.

3. The tail pipe assembly of claim 1, wherein the at least one main collecting element covers substantially an entire interior circumference of the tail pipe.

4. The tail pipe assembly of claim 1, wherein the tail pipe is bent toward a ground.

5. The tail pipe assembly of claim 1, wherein:

the at least one main collecting element includes two main collecting elements that are mounted to an upper portion and a lower portion of an interior circumference of the tail pipe and are apart from each other.

6. The tail pipe assembly of claim 1, wherein the at least one main collecting element is formed substantially as a weave.

7. The tail pipe assembly of claim 1, wherein the at least main collecting element has substantially a wave shape.

8. The tail pipe assembly of claim 1, wherein the at least one main collecting element is formed to have convex protrusions and concave depressions.

9. A tail pipe assembly for a vehicle comprising:

a tail pipe mounted to a muffler of the vehicle and discharging exhaust gas and condensation water to an outside; and at least one main collecting element that is mounted within the tail pipe, suppresses flow of the condensation water and temporarily stores the condensation water;

wherein the tail pipe further comprises at least one collecting plate that is disposed within the tail pipe and temporarily stores the condensation water.

10. The tail pipe assembly of claim 9, wherein:

the at least one collecting plate includes two collecting plates that are mounted to an upper portion and a lower portion of an interior circumference of the tail pipe.

11. The tail pipe assembly of claim 9, wherein a plurality of collecting holes are formed in the at least one collecting plate for temporarily storing the condensation water.

12. A tail pipe assembly for a vehicle comprising:

a tail pipe mounted to a muffler of the vehicle and discharging exhaust gas and condensation water to an outside; and at least one main collecting element that is mounted within the tail pipe, suppresses flow of the condensation water and temporarily stores the condensation water;

wherein the at least one main collecting element is mounted to an upper portion of an interior circumference of the tail pipe, and wherein the tail pipe further comprises a sub-collecting element that is mounted to a lower portion of the interior circumference of the tail pipe for temporarily storing the condensation water.

13. The tail pipe assembly of claim 12, wherein the tail pipe further comprises a collecting plate that is mounted upstream of the sub-collecting element for temporarily storing the condensation water.

14. The tail pipe assembly of claim 13, wherein a plurality of collecting holes are formed in the at least one collecting plate for temporarily storing the condensation water.

15. The tail pipe assembly of claim 1, wherein the at least one main collecting element is mounted to an upper portion of an interior circumference of the tail pipe, and wherein the tail pipe has an extended portion that is extended from the muffler and a sub-collecting element is mounted to a lower portion of the extended portion for suppressing the flow of the condensation water and temporarily storing the condensation water.

16. The tail pipe assembly of claim 9, further comprising:

a mounting portion connected to the tail pipe, the mounting portion having a cross section that is larger than the tail pipe, wherein the at least one main collecting element is mounted to the mounting portion.

17. The tail pipe assembly of claim 9, wherein the at least one main collecting element covers substantially an entire interior circumference of the tail pipe.

18. The tail pipe assembly of claim 9, wherein the at least one main collecting element includes two main collecting elements that are mounted to an upper portion and a lower portion of an interior circumference of the tail pipe and are apart from each other.

19. The tail pipe assembly of claim 9, wherein the at least one main collecting element is mounted to an upper portion of an interior circumference of the tail pipe, and wherein the tail pipe has an extended portion that is extended from the muffler and a sub-collecting element is mounted to a lower portion of the extended portion for suppressing the flow of the condensation water and temporarily storing the condensation water.

* * * * *